US006425147B1

(12) United States Patent
Hanson

(10) Patent No.: US 6,425,147 B1
(45) Date of Patent: Jul. 30, 2002

(54) TUB SURROUND ASSEMBLY CLIP

(75) Inventor: Darrell Hanson, Adamsville, TN (US)

(73) Assignee: Aqua Glass Corporation, Adamsville, TN (US)

( * ) Notice: Subject to any disclaimer, the term of this patent is extended or adjusted under 35 U.S.C. 154(b) by 0 days.

(21) Appl. No.: 09/706,974

(22) Filed: Nov. 6, 2000

Related U.S. Application Data

(60) Provisional application No. 60/163,965, filed on Nov. 8, 1999.

(51) Int. Cl.[7] ..... A47K 3/02
(52) U.S. Cl. ..... 4/584; 52/582.1
(58) Field of Search ..... 4/584, 612, 614; 52/35, 79.1, 582.1, 582.2

(56) References Cited

U.S. PATENT DOCUMENTS

| | | | | | |
|---|---|---|---|---|---|
| 2,648,409 | A | | 8/1953 | Daugherty et al. | 52/35 X |
| 3,667,177 | A | | 6/1972 | Biela | 52/35 X |
| 3,688,459 | A | * | 9/1972 | Mattix | 52/35 |
| 4,316,295 | A | | 2/1982 | Whitney et al. | 4/612 |
| 4,384,377 | A | | 5/1983 | Calvert et al. | 4/614 |
| 4,578,832 | A | | 4/1986 | Primucci | 4/614 |
| 4,691,392 | A | | 9/1987 | Whitney | 52/35 X |
| 4,817,344 | A | | 4/1989 | Wissinger | 52/35 |
| 4,901,380 | A | | 2/1990 | Smith | 4/596 |
| 5,263,208 | A | | 11/1993 | Smith | 4/612 |
| 5,473,843 | A | | 12/1995 | LaRoche et al. | 52/35 |
| 5,671,489 | A | * | 9/1997 | Salach | 4/614 |

* cited by examiner

*Primary Examiner*—Robert M. Fetsuga
(74) *Attorney, Agent, or Firm*—Edgar A. Zarins; Lloyd D. Doigan

(57) ABSTRACT

A multi-panel tub/shower surround which facilitates insertion well into the construction process. The panels incorporate assembly clips along a common vertical edge which maintain the panels in sealing engagement. The assembly clip induces a watertight connection between the panels to maintain the common edge in flush engagement. As a result, a tub surround can be positioned later in the construction process while ensuring a watertight connection between the components of the surround.

18 Claims, 3 Drawing Sheets

TUB SURROUND ASSEMBLY CLIP

RELATED APPLICATIONS

This application claims priority from U.S. Provisional Application No. 60/163,965 filed Nov. 8, 1999.

BACKGROUND OF THE INVENTION

I. Field of the Invention

This invention relates to the assembly of multi-piece tub and shower surrounds and, in particular, to a clip for joining and maintaining a watertight connection between wall panels of the surround.

II. Description of the Prior Art

Preformed tub and shower surrounds have become increasingly popular as a cost-effective means of providing a stylized waterproof wall for the tub/shower enclosure. Previously, the tub or shower base would be installed in the bathing area of the home in conjunction with the plumbing. In order to prevent water damage to the walls, tiling could be applied to direct water to the drain. However, tiled walls are relatively expensive because of the cost of the materials and labor.

Single piece tub and shower surrounds provide a watertight enclosure at a reasonable cost. The surrounds can be molded with a variety of special features including shelves and decorative designs. However, the single piece structure typically including at least three walls and a basin, requires that the entire closure be set as the walls are being roughed in. Without care, these surrounds can become damaged or marred as construction of the home continues. Planar wall panels have been utilized to finish the walls around the tub/shower, however these do not incorporate the design and convenience features of the molded surrounds.

SUMMARY OF THE PRESENT INVENTION

The present invention overcomes the disadvantages of the prior known tub/shower surrounds by providing a multi-piece surround construction connected by assembly clips to maintain integral connection between the components of the surround.

The present invention generally comprises a tub or shower basin and a plurality of wall panels to form a surround along three walls. The opening to the tub or shower may be subsequently enclosed by doors or a shower curtain. While the invention provides for more, in a preferred embodiment, the surround is formed by a pair of corner wall panels connected along a single vertical seam. Such corner panels can be easily maneuvered into the home and positioned on the tub even well into the construction process.

In order to maintain sealing contact between the panels, a series of clips are mounted along the seam edge of the panels. The clips are vertically spaced along the seam edge and are mounted to blocks molded into the rear of the wall panels. The clip assembly includes spring arms which engage corresponding bearing blocks on the adjacent panel to prevent separation of the wall panels. The spring arms biasingly engage to blocks to maintain the panels in sealing contact.

With the tub or shower base secured in place, a first wall panel is positioned on the ledge thereof. The panels include a lower lip which extends over the edge of the tub to prevent water flow therebetween and a flange member to bias against the rear of the tub. The second or subsequent panel is pivoted into place to engage the assembly clips with their corresponding bearing block and ensure flush contact between the vertical edges of the panel. In the event the panels need to be separated, the second panel can be raised to slide the clips past the block and facilitate removal of the panel. Once the panels are positioned as desired they can be fastened into place. The vertical edge seam includes overlapping wall portions to further prevent the flow of water therebetween. In a preferred embodiment, a caulk channel is provided such that a sealing bead of caulk can be inserted between the wall portions. However, the multi-piece assembly is considerably simpler to move into the home and can be placed later into the construction.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing in which like reference characters refer to like parts throughout the views and in which:

FIG. 5 is an enlarged view of the assembly clip being pivoted into connection to secure the wall panels.

DETAILED DESCRIPTION OF A PREFERRED EMBODIMENT OF THE PRESENT INVENTION

Figure 1:
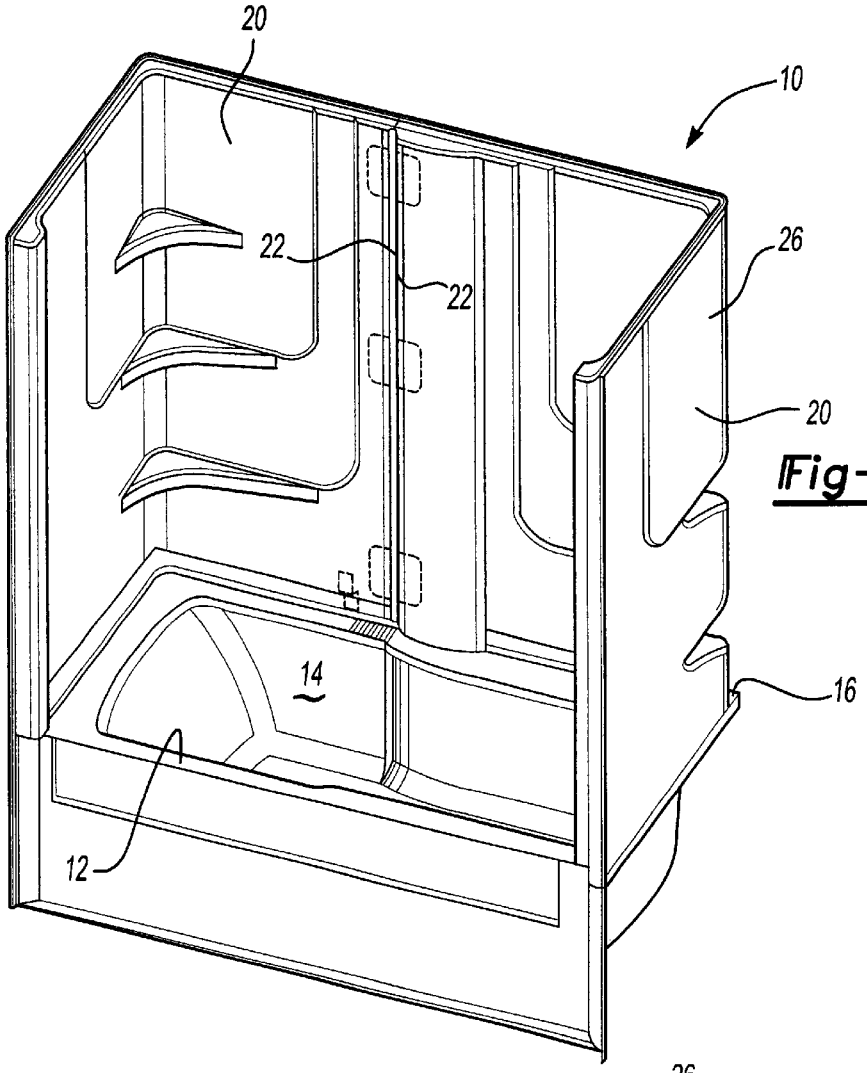
FIG. 1 is a perspective view of a tub surround embodying the present invention.
Figure 2:
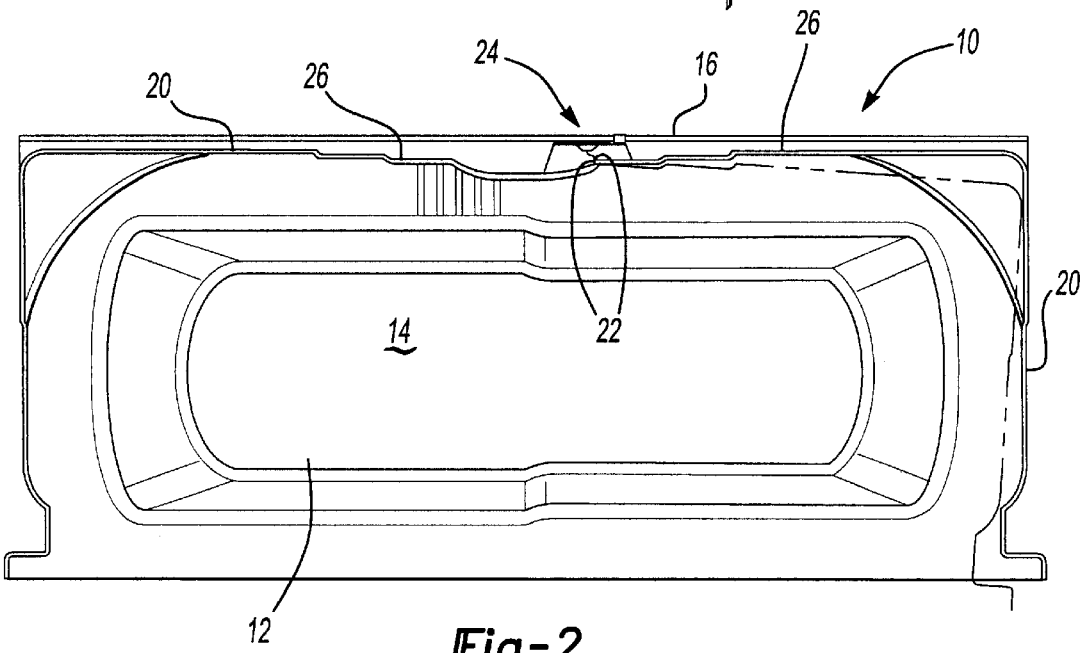
FIG. 2 is a top plan view of the surround showing a wall panel being pivoted into position.

Referring first to FIGS. 1 and 2, there is shown a tub surround 10 for creating a bathing enclosure. The surround 10 generally includes a bathtub 12 and a plurality of wall panels 20. Typically, the wall panels 20 will form a three-sided surround with a front opening which can be enclosed with a door or curtain (not shown). Although the present invention will be generally described in connection with the bathtub 12 it is to be understood that a shower surround could be constructed in conjunction with a shower base. In addition, for simplicity of understanding, the surround 10 will be described in conjunction with a pair of cooperating wall panels 20 although the present invention will operate in connection with a greater number of wall panels 20. The bathtub 12 preferably includes a bathing well 14 and a peripheral ledge 16.

Figure 3:
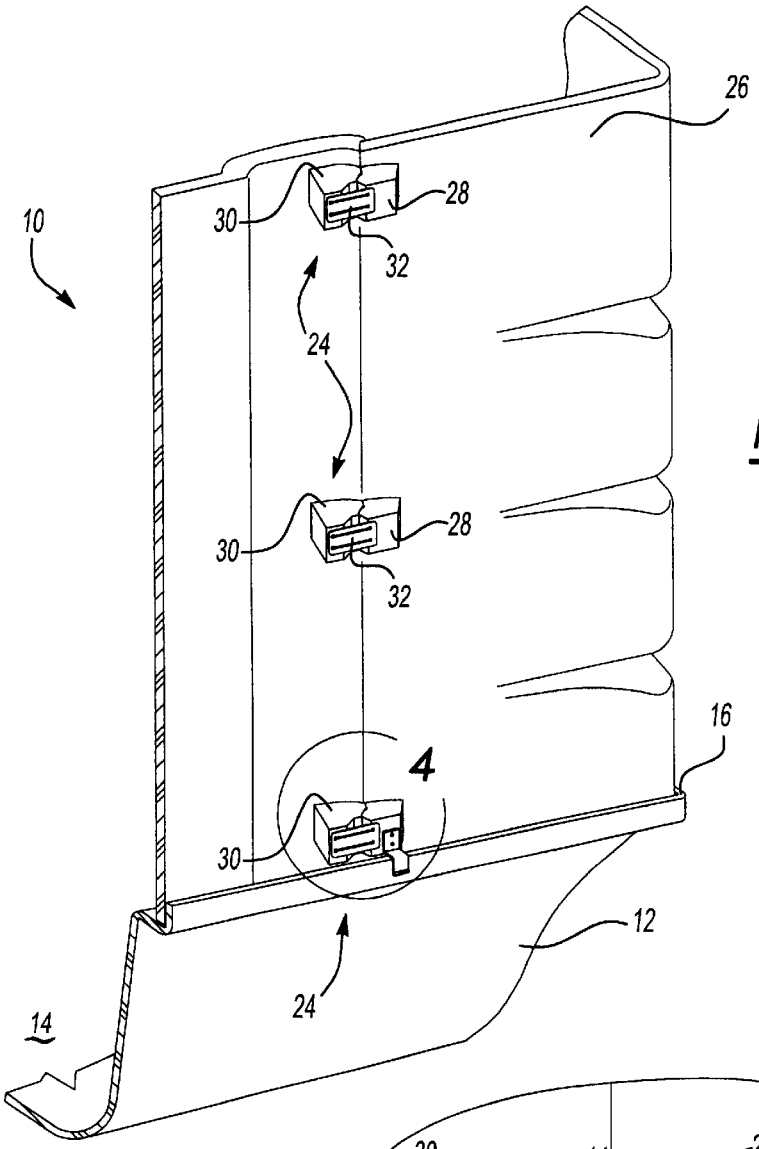
FIG. 3 is a rear perspective view of the surround.
Figure 4:
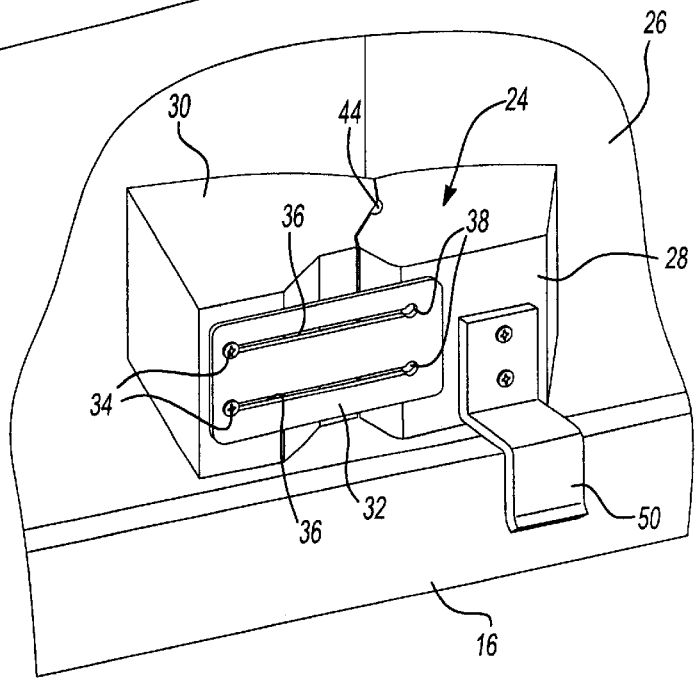
FIG. 4 is an enlarged view of an assembly clip engaging to secure the wall panels.

The wall panels 20 which form the surround include a cooperating vertical edge 22. As best shown in FIGS. 3 through 5, a series of assembly clips 24 are mounted to a rear 26 of the panels 20 proximate the vertical edge 22. In a preferred embodiment of the invention, mounting blocks 30 are molded into the rear 26 of the panels 20 in spaced apart relation along the edge 22. These blocks 30 form an integral part of the panel 20 and are molded during molding of the panels 20. The blocks 30 provide a structure for securement of the assembly clips 24 as will be subsequently described. The opposing wall member 20 similarly includes a series of spaced apart bearing blocks 28 molded into the wall portion 20. The bearing blocks 28 are spaced along the vertical edge 22 and form a bearing surface engageable by the clips 24 as will be described.

The assembly clips 24, which are spaced along the vertical edge 22, consist of a spring arm 32 fastened to the mounting block 30 and positioned to biasingly engage the bearing block 28 upon assembly of the wall panels 20. In a preferred embodiment, the spring arm 32 is secured to the mounting block 30 by fasteners 34 which are received in slots 36 extending longitudinally along the spring arm 32. The slots 36 allow lateral adjustment of the spring arms 32 relative to the mounting block 30 and vertical edge 22. The slots 36 also facilitate retraction of the spring arms 32 during transport of the panels 20. The slots 36 may include apertures 38 to allow removal of the spring arms 32 without removing the fasteners 34.

Figure 5A:
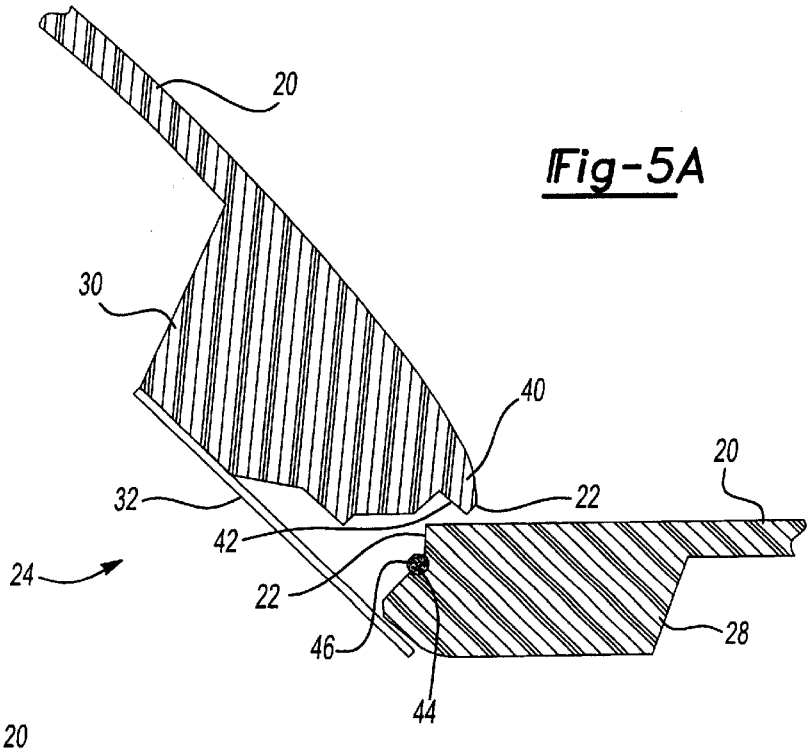
FIGS. 5A, 5B and 5C are enlarged views of the assembly clip being pivoted into position to secure the wall panels.
Figure 5B:
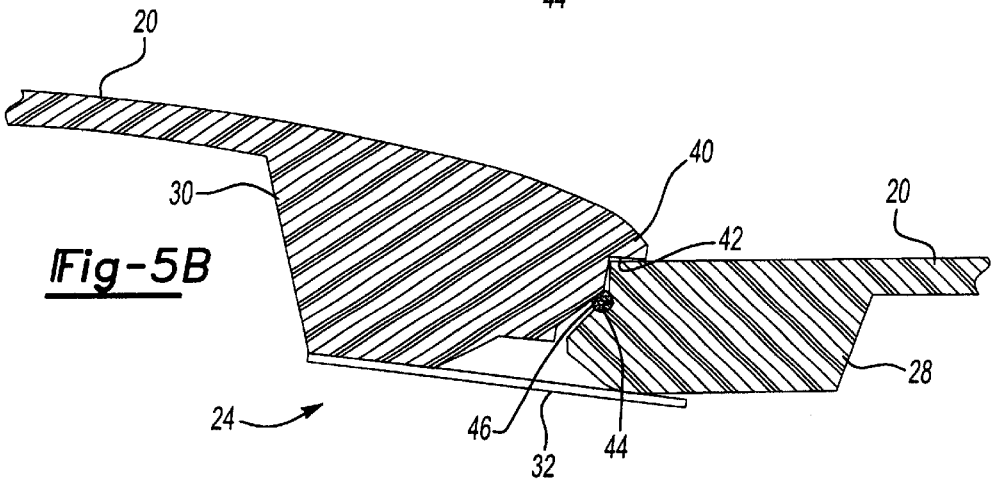
Figure 5C:
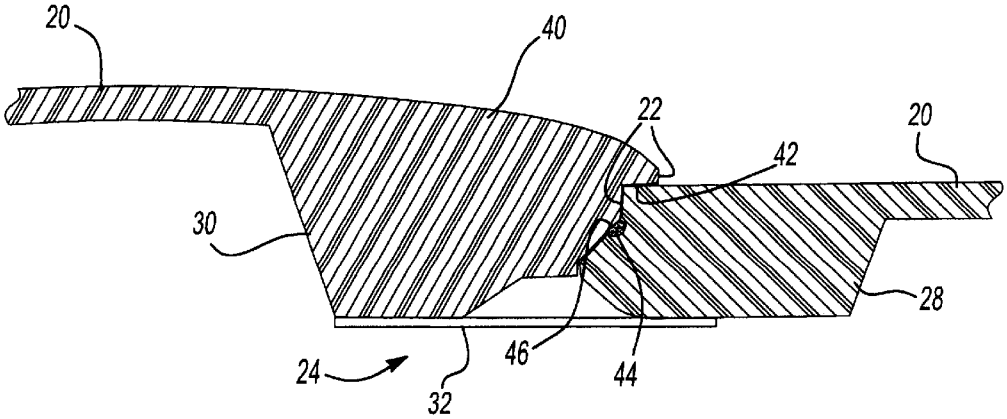

As best shown in FIGS. 5A–5C, the wall panels 20 include overlapping edges to prevent the flow of water between the panels 20. The biasing force of the spring arms 32 will ensure sealing engagement between the walls. In a preferred embodiment, the wall panel 20 which carries the spring arm 32 is molded with an enlarged lip 40 along the vertical edge 22. Formed in the backside of the lip 40 is a notch 42 configured to matingly receive the edge 22 of the other panel 20. In the embodiment shown in the drawing, the other edge 22 is square and the notch 42 is formed at a right angle to receive the square edge 22. One or other of the edges 22 may include a groove 44 extending the height of the panel 20 for receiving a seal or a bead of caulking 46 to further prevent fluid flow past the seam. The spring arm 32, once the wall panels 20 are aligned, will bias the lip 40 against the edge 22 of the other panel 20 to secure the seam.

The connector assembly 24 of the surround 10 allows convenient assembly of the wall panels 20 at the construction site. By providing a multi-piece surround 10, the assembly is more easily carried into the bathing area and can be installed later in the construction to reduce the possibility of damage. With the tub 12 in position, a first wall panel 20 is positioned on the ledge 16. The first panel 20 may be glued or nailed in position if desired. As an alternative, downwardly depending flange 50 may pass behind the edge 16 of the bathtub 12 to prevent separation of the panel 20 from the bathtub 12. A second panel 20 can be brought in for engagement with the first panel 20. Because of limited space, the second panel 20 will be pivoted in position passing the spring arms 32 behind the first panel 20. The spring arm 32 will engage the bearing block 28 as the second panel 20 is pivoted into position next to the first panel. The bearing block 28 is configured to ensure a biasing force to draw the panels together. If it becomes necessary to remove the second panel 20, the panel 20 can be pivoted away from the other panel 20. Thereafter, the panel 20 can again be engaged by pivoting the second panel into place alongside the first panel.

The foregoing detailed description has been given for clearness of understanding only and no unnecessary limitations should be understood therefrom as some modifications will be obvious to those skilled in the art without departing from the scope and spirit of the appended claims.

What is claimed is:

1. A wall surround for a bathing unit comprising:

a plurality of wall panels arranged in contiguous relation to form said wall surround, said wall panels having a vertical edge whereby said vertical edge of a first wall panel is disposed adjacent said vertical edge of a second wall panel forming a vertical seam, said wall panels including at least one mounting block formed in a rear face of said first wall panel along said vertical edge and at least one bearing block formed in said rear face of said second wall panel along said vertical edge; and at least one assembly clip secured to a mounting block of said first wall panel and extending across said vertical seam to engage a bearing block of said second wall panel to selectively join said contiguous wall panels.

2. The wall surround as defined in claim 1 wherein said at least one assembly clip includes a spring arm secured to said bearing block on said rear face of said first wall panel, said spring arm selectively engaging said second wall panel to prevent separation of said wall panels.

3. The wall surround as defined in claim 2 wherein said wall panels include a plurality of assembly clips spaced along said vertical edges of said wall panels.

4. The wall surround as defined in claim 3 wherein said wall panels include a plurality of blocks molded into said rear face of said wall panels along said vertical edge.

5. The wall surround as defined in claim 4 wherein said vertical edge of said first wall panel includes an overlap lip, said overlap lip receiving said vertical edge of said second wall panel, said spring arm engaging said bearing block to bias said overlap lip against said vertical edge of said secured wall panel.

6. The wall surround as defined in claim 5 wherein said wall panels consist of a corner panel having an inner vertical edge, a pair of said corner panels joined in contiguous relation to form said surround having a single vertical seam therebetween.

7. A wall surround for a bathing unit comprising:

a plurality of wall panels arranged in contiguous relation to form said wall surround, said wall panels having a vertical edge wherein said vertical edge of a first wall panel includes a plurality of mounting blocks and is disposed adjacent said vertical edge of a second wall panel forming a vertical seam in said wall surround; and a plurality of assembly clips mounted to said mounting blocks spaced along said vertical seam and extending across said vertical seam to selectively join said contiguous wall panels.

8. The wall surround as defined in claim 7 wherein said assembly clips are mounted to a rear face of said wall panels and include a spring arm secured to said rear face of a first wall panel, said spring arm selectively engaging said rear face of a second wall panel to prevent separation of said wall panels.

9. The wall surround as defined in claim 8 wherein said vertical edge of said first wall panel includes an overlap lip, said overlap lip receiving said vertical edge of said second wall panel, said spring arm engaging said bearing block to bias said overlap lip against said vertical edge of said secured wall panel.

10. The wall surround as defined in claim 9 wherein said rear face of said second wall panel includes a plurality of bearing blocks spaced along said vertical edge.

11. The wall surround as defined in claim 9 wherein said vertical edges of said first and second wall panels form an offset seam therebetween, said seam concealed by said overlap lip to prevent fluid flow into said seam.

12. The wall surround as defined in claim 11 wherein said vertical seam includes a seal channel extending the length of said seam, said seal channel receiving a sealing material to prevent fluid flow through said seam.

13. The wall surround as defined in claim 12 wherein said wall panels consist of a pair of corner panels having an inner vertical edge joined in contiguous relation to form said surround having a single vertical seam.

14. A wall surround for a bathing unit comprising:

a first corner panel having an interior vertical edge, said first and second corner panels arranged in contiguous relation to form said wall surround such that said vertical edge of said first corner panel is adjacent said vertical edge of said second corner panel forming an intermediate vertical seam in said wall surround; and a plurality of mounting blocks formed in a rear face along said vertical edge of said first corner panel, each of said mounting blocks having an assembly clip mounted thereto and extending across said vertical seam to selectively engage said second corner panel and join said contiguous corner panels, said assembly clips including a spring arm adjustably mounted to said first corner panel and biasingly engaging said second corner panel.

15. The wall surround as defined in claim 14 wherein said rear face of said second wall panel includes a plurality of bearing blocks spaced along said vertical edge, said spring arms biasingly engaging said bearing blocks.

16. The wall surround as defined in claim 14 wherein said vertical edges of said first and second wall panels form an offset seam therebetween, said seam concealed by said overlap lip to prevent fluid flow into said seam.

17. The wall surround as defined in claim 16 wherein said vertical seam includes a seal channel extending the length of said seam, said seal channel receiving a sealing material to prevent fluid flow through said seam.

18. The wall surround as defined in claim 15 wherein said vertical edge of said first wall panel includes an overlap lip, said overlap lip receiving said vertical edge of said second w all panel, said spring arm engaging said bearing block to bias said overlap lip against said vertical edge of said second wall panel.

* * * * *